US006618866B1

(12) United States Patent
Edmondson

(10) Patent No.: US 6,618,866 B1
(45) Date of Patent: Sep. 16, 2003

(54) VACUUM TANK CONSTRUCTION

(75) Inventor: Lorna K. Edmondson, Londonville, OH (US)

(73) Assignee: Sealand Technology, Inc., Big Prairie, OH (US)

( * ) Notice: Subject to any disclaimer, the term of this patent is extended or adjusted under 35 U.S.C. 154(b) by 0 days.

(21) Appl. No.: 09/722,542

(22) Filed: Nov. 28, 2000

Related U.S. Application Data

(60) Provisional application No. 60/181,067, filed on Feb. 8, 2000.

(51) Int. Cl.[7] ..... E03D 11/00
(52) U.S. Cl. ..... 4/431; 4/321
(58) Field of Search ..... 4/431, 432, 433, 4/321, 323; 137/526, 565.23, 590, 587; 417/36

(56) References Cited

U.S. PATENT DOCUMENTS 2,193,466 A * 3/1940 Raymond ..... 137/590
5,139,655 A * 8/1992 Sigler ..... 210/140
5,282,281 A * 2/1994 Clear et al. ..... 4/434
5,345,618 A * 9/1994 Sigler et al. ..... 4/321
5,535,770 A * 7/1996 Nurmi ..... 137/14
5,621,924 A 4/1997 Friedman et al.
5,931,642 A * 8/1999 Friedman et al. ..... 417/36
5,960,829 A * 10/1999 Sigler ..... 137/614.03
6,148,860 A * 11/2000 Sigler ..... 137/846
6,234,197 B1 * 5/2001 McKiernan et al. ..... 137/526

* cited by examiner

*Primary Examiner*—Gene Mancene
*Assistant Examiner*—Huyen Le
(74) *Attorney, Agent, or Firm*—Pearne & Gordon LLP

(57) ABSTRACT

A vacuum tank assembly includes a vacuum tank that has a low profile and will fit in small, and particularly low height, compartments of a boat or RV. The tank is connected to a vacuum toilet and a vacuum pump during use. The tank preferably has a generally rectangular prism configuration, and has a front surface in which openings for receipt of a dip tube assembly, sewage inlet (from the toilet), and vacuum switch are provided. The dip tube assembly includes an adaptor operatively connected to the vacuum pump and an evacuator component which has a generally tubular configuration and a substantially flat open bottom closely overlying the bottom interior of the tank. A locator tab cooperates with a cut out in the tank front surface to properly position the evacuator open bottom adjacent the tank bottom.

15 Claims, 7 Drawing Sheets

VACUUM TANK CONSTRUCTION

CROSS-REFERENCE TO RELATED APPLICATION

This application is based upon provisional application serial No. 60/181,067 filed Feb. 8, 2000, the disclosure of which is hereby incorporated by reference herein.

BACKGROUND AND SUMMARY OF THE INVENTION

In U.S. Pat. No. 5,621,924 (the disclosure of which is hereby incorporated by reference herein) a vacuum tank construction for use with a vacuum toilet assembly is illustrated that has a number of advantages over the prior art. According to the present invention a modification of the vacuum tank construction in the U.S. Pat. No. 5,621,924 patent is provided that has a number of advantages in certain circumstances. While the vacuum tank according to the present invention functions in primarily the same manner as in the U.S. Pat. No. 5,621,924 patent, the construction according to the invention has a lower profile while retaining the same functionality. The lower profile permits mounting in areas where the vacuum tank in the U.S. Pat. No. 5,621,924 patent is too tall.

Also the vacuum tank construction according to the invention has a different dip tube assembly construction that can be installed through the side of the tank, as opposed to a top portion of the tank in the U.S. Pat. No. 5,621,924 patent.

The dip tube assembly according to the invention has a two piece configuration with O-ring seals between the pieces that provides a close coupling of the tank and pump with a minimum overall length of the tank and pump combination. This minimum overall length permits installation of the vacuum tank where other configurations do not fit, particularly important on boats and recreational vehicles where the vacuum tanks of the invention are designed to be used. Also the dip tube assembly according to the invention has less material than in the U.S. Pat. No. 5,621,924 dip tube, and has better evacuation of the tank and less tendency to plug.

According to one aspect of the present invention there is provided a vacuum tank assembly comprising: A plastic vacuum tank having a substantially hollow interior, and a generally rectangular prism exterior configuration, including top, bottom, front, rear, and side surfaces. A first opening in the front surface. And, a dip tube assembly mounted in the first opening in a position such that sewage in the tank may be readily withdrawn therefrom adjacent the bottom surface thereof, and constructed to readily connect to a vacuum pump.

The assembly preferably further comprises second and third openings defined in the front surface, and desirably the top surface is substantially devoid of openings. Also desirably the tank has no continuous flat surface greater than 80 square inches in area.

In desired operation, the second opening is typically operatively connected to a vacuum switch of conventional construction, and the third opening is operatively connected to a sewage inlet conduit (in turn connected to a vacuum toilet as disclosed in the U.S. Pat. No. 5,621,924 patent). A vacuum pump and outlet conduit are also operatively connected to the dip tube assembly.

In the preferred embodiment the dip tube assembly comprises an adaptor and an evacuator component, the adaptor connecting the evacuator component to an outlet conduit or vacuum pump, and the evacuator component comprising a substantially tubular evacuation portion having a substantially flat open bottom closely overlying the tank bottom surface in the tank open interior. Also preferably the adaptor comprises a mounting flange and a substantially tubular rear portion extending outwardly from the mounting flange, the rear portion having at least one sealing element associated with an exterior surface thereof. Also preferably the evacuator component comprises a substantially tubular connector portion having an interior surface making a substantially air and liquid-tight seal with the sealing element.

In the preferred embodiment the evacuator component connector portion has at least one radially extending locator tab, and the assembly further comprises at least one cut out in the tank front surface adjacent the first opening cooperating with the tab to properly orient the evacuator component in the tank. Also preferably the locator tab has a substantially polygonal cross-section and is removably mounted to the evacuator component. Alternatively the locator tab is integral with the evacuator component connector portion.

According to another aspect of the present invention there is provided a vacuum tank assembly comprising: A vacuum tank having a substantially hollow interior and an exterior having top, bottom, and front surfaces. A first opening in the front surface. A dip tube assembly mounted in the first opening in a position such that sewage in the tank may be readily withdrawn therefrom adjacent the bottom surface thereof, and constructed to readily connect to a vacuum pump. And, wherein the dip tube assembly comprises an adaptor and an evacuator component, the adaptor connecting the evacuator component to an outlet conduit or vacuum pump, and the evacuator component comprising a substantially tubular evacuation portion having a substantially flat open bottom closely overlying the tank bottom surface in the tank open interior.

The details of the dip tube assembly are preferably as described above.

According to another aspect of the present invention there is provided a dip tube assembly per se comprising: An adaptor and an evacuator component, the adaptor connecting the evacuator component to an outlet conduit or vacuum pump, and the evacuator component comprising a substantially tubular evacuation portion having a substantially flat open bottom closely overlying the tank bottom surface in the tank open interior. The adaptor comprising a mounting flange and a substantially tubular rear portion extending outwardly from the mounting flange, the rear portion having at least one sealing element associated with an exterior surface thereof; and the evacuator component comprising a substantially tubular connector portion having an interior surface making a substantially air and liquid-tight seal with the sealing element. And, at least one locator tab extending radially outwardly from the evacuator component connector portion.

It is the primary object of the present invention to provide a low profile vacuum tank having the same or improved functionality as conventional vacuum tanks, and a desirable dip tube assembly for use therewith. This and other objects of the invention will become clear from an inspection of the detailed description of the invention and from the appended claims.

DETAILED DESCRIPTION OF THE DRAWINGS

Figure 1:
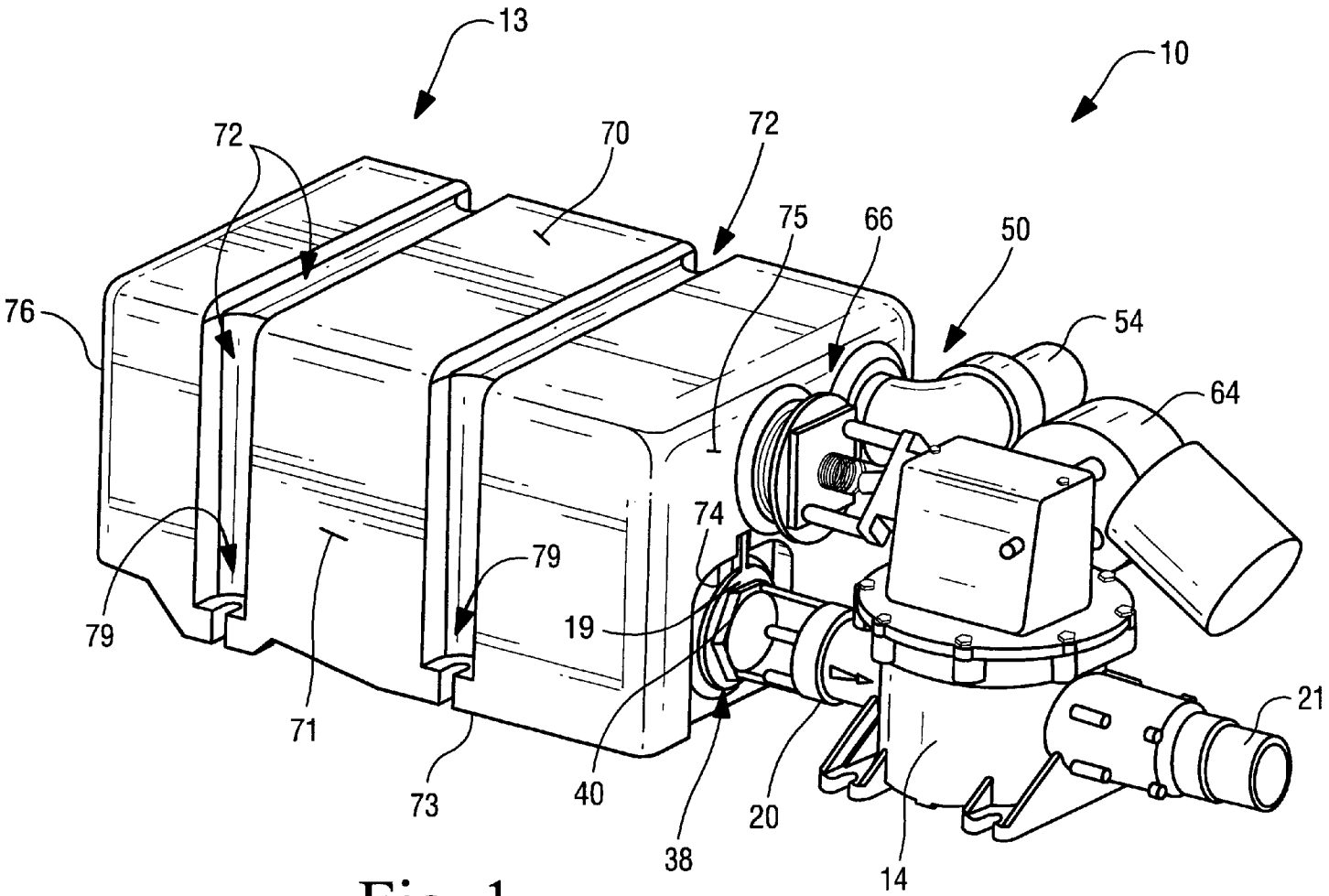
FIG. 1 is a perspective view of an exemplary vacuum tank assembly according to the present invention usable in a vacuum toilet assembly as in the U.S. Pat. No. 5,621,924 patent.
Figure 2:
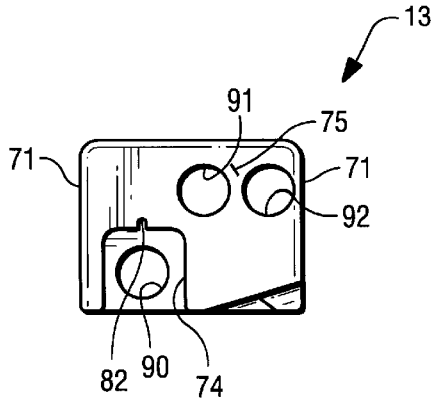
FIG. 2 is a front end view of the vacuum tank of FIG. 1.
Figure 3:
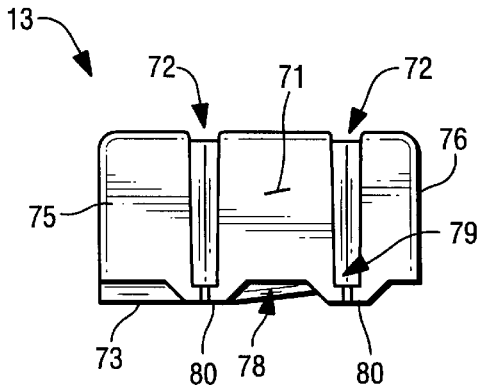
FIGS. 3 and 4 are left and right side views, respectively, looking in on the front of the vacuum tank of FIGS. 1 and 2.
Figure 4:
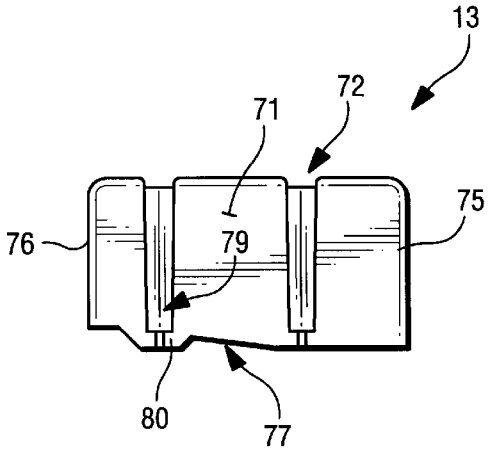
Figure 5:
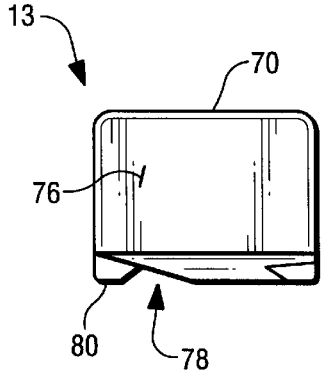
FIG. 5 is a rear view of the vacuum tank of FIGS. 1 through 4.
Figure 6:
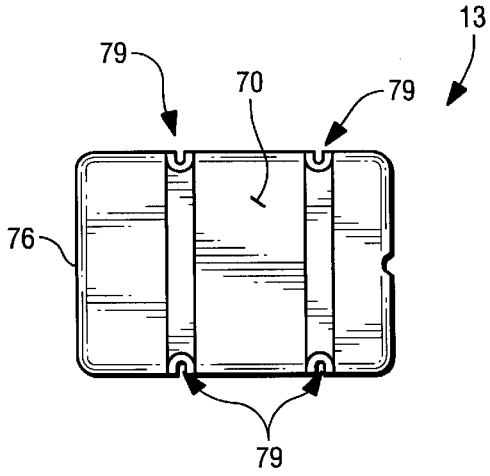
FIG. 6 is a top plan view of the vacuum tank of FIGS. 1 through 5.
Figure 7:
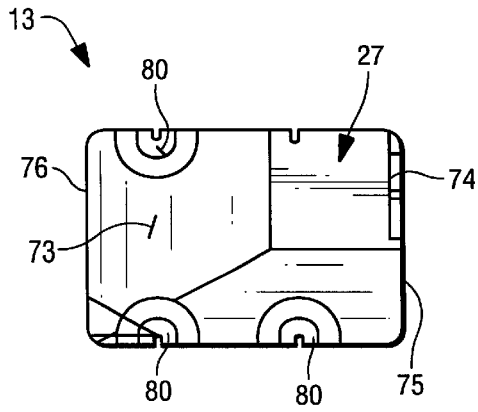
FIG. 7 is a bottom plan view of the vacuum tank of FIGS. 1 through 6.
Figure 8:
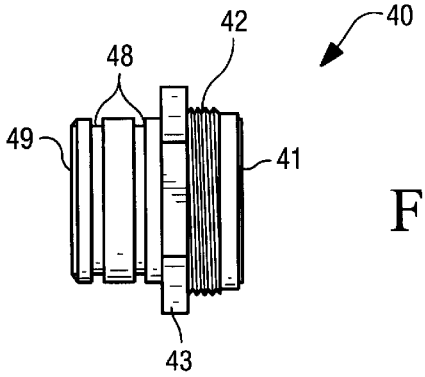
FIG. 8 is a side view, with O-rings removed, of the adapter component of the dip tube assembly according to the invention.
Figure 9:
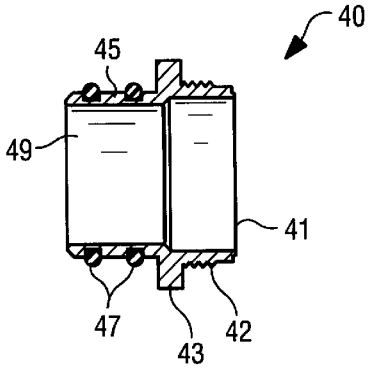
FIG. 9 is a longitudinal cross-sectional view, with the O-rings illustrated, of the component of FIG. 8.
Figure 10:
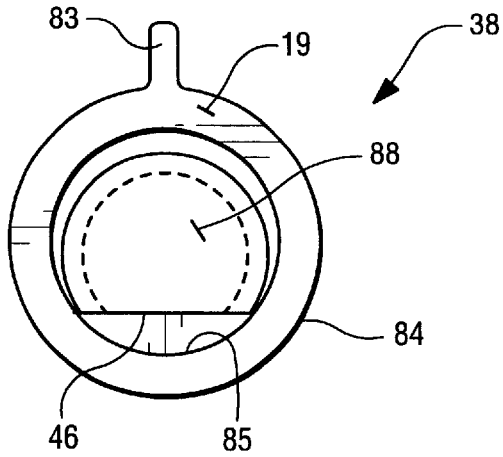
FIG. 10 is a front end view of the evacuation component of the dip tube assembly according to the present invention.
Figure 11:
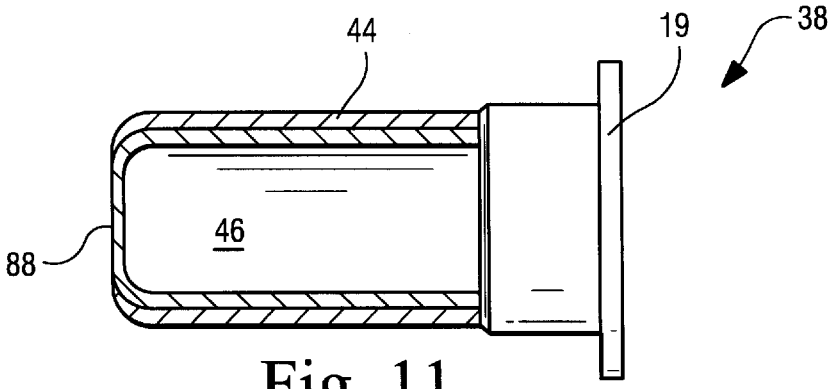
FIG. 11 is a bottom plan view of the component of FIG. 10.
Figure 12:
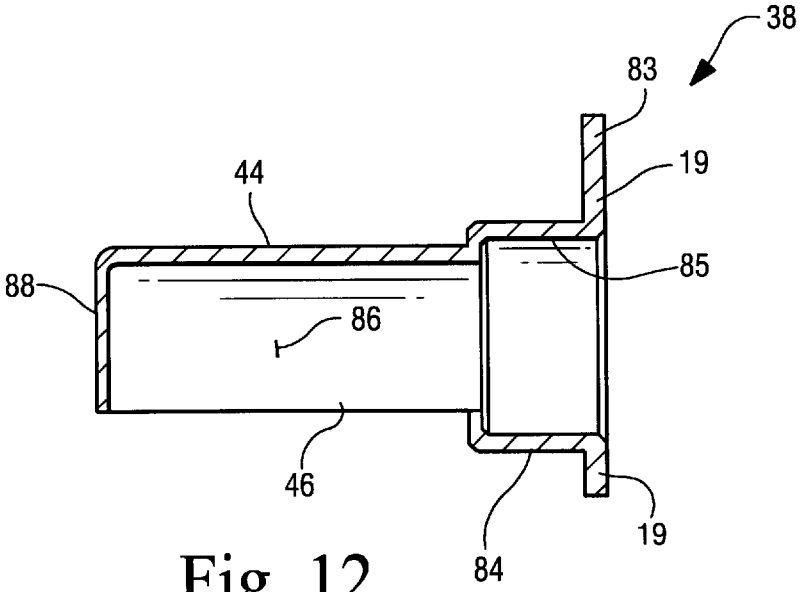
FIG. 12 is a side cross-sectional view of the component of FIGS. 10 and 11.

The vacuum tank 13 illustrated in FIGS. 1 through 7 is preferably made of plastic, such as low density polyethylene, preferably with a nominal wall thickness typically between about 0.25 and 0.4 inches, e.g. about 0.312 inches, with no flat surface area of greater than about 80 square inches. Unlike the tank in the U.S. Pat. No. 5,621,924 patent, the vacuum tank 13 has a fairly regular configuration, generally approximating a rectangular parallelepiped or prism. The vacuum tank 13 is connected up to other portions of a vacuum tank toilet assembly as shown in U.S. Pat. No. 5,621,924. The tank 13 includes a sewage inlet conduit (e.g. pipe fitting) 50 having an open end section 54 that is connected to the inlet of the tank 13, the end 54 being connected by a flexible hose or the like to a vacuum toilet (as seen in U.S. Pat. No. 5,621,924); a vacuum pump 14 that is connected by an outlet conduit 20 to the outlet from the tank 13 and the pump 14 itself having an outlet 21 that is connected to a waste/holding tank (as seen in U.S. Pat. No. 5,621,924); and a motor 64 for powering the pump 14. The tank 13 may also have other conventional structures associated therewith such as the conventional vacuum switch 66 for controlling the motor 64.

The tank 13 has a top 70, and sides 71, with surface manifestations 72 in the top 70 and sides 71 to provide strength to the tank 13 and minimize any flat continuous surface 15 area of the tank 13. The tank 13 also has a bottom 73, front end 75, and rear end 76. The front end 75 has a cut out therein for the dip tube assembly including the components 38, 40 [the components 38, 40 are preferably also made of plastic, such as polypropylene] thereof which will be described more fully with respect to FIGS. 8 through 12. Preferably all of the components penetrating the tank 13 penetrate the front wall 75, including the sewage inlet conduit 50 and the vacuum switch 66. The conduit 20 is connected to the inlet to the tank 13 at the cut out 74 (note that in FIG. 1 the conduits 20, 21 are partially cut away for clarity of illustration).

The tank 13 preferably also has mounting flanges 79, at least some of which terminate in feet 80 that support the tank 13 on a surface on which it rests or to which it is attached. The tank 13 may be attached to a surface on which it is mounted by placing fasteners extending through the openings in the mounting flanges 79 into the mounting surface. The bottom 73 may be contoured as indicated at 77 and 78 in FIGS. 3 through 5 and 7, so as to have an uneven configuration so that pumpable waste in the tank 13 has a tendency to flow slightly toward the front end 75, which is substantially the lowest portion of the interior of the tank 13.

Because of the particular generally rectangular prism configuration of the tank 13 and the mounting of the components 50, 66, 14, etc., associated therewith, the tank and pump assembly 13, 14 can have a minimum length, and the entire assembly can have a minimum height, making it easy to mount in areas with restricted volumes.

The dip tube assembly that is operatively connected to the conduit 20 at the cut out 74 in the front 75 of the tank includes two components 40 (seen in FIGS. 8 and 9) and 38 (seen in FIGS. 10 through 12), just portions of those components being visible in FIG. 1.

The adapter component 40 of the dip tube assembly has a first open end 41 with external screw threads 42 thereon for connection with the conduit 20 or the like. It also has a mounting flange 43 which engages the front surface of the evacuation component 38 and the front surface 75 of the tank 13 at the cut out 74, and a rear portion 45 preferably having two O-rings 47 mounted in grooves 48 therein, the portion 45 also being open at the end 49.

The evacuator component 38 of the dip tube assembly according to the invention has a front locating flange 19 which has a locating tab 83 thereon which cooperates with a cut out 82 (see FIG. 2) in the front wall 75 of the tank 13 which is a continuation of the cut out 74, to properly locate the substantially flat open bottom 46 of the substantially tubular (substantially circular or polygonal in cross-section not considering the substantially flat open bottom 46) evacuation portion 44 (which is a substantially straight tubular portion closed on the top, sides, and one end, and open at the bottom and at the end connected to the portion 84) of the component 38. The component 38 includes a first substantially tubular connector portion 84 which comprises a substantially closed annulus, having an interior substantially cylindrical surface 85, an open interior 86 communicating with the open bottom 46 on the opposite side of the annular portion 84 from the flange 19, and a closed rear wall 88.

The front surface 75 of the tank 13 preferably has at least first 90, second 91, and third 92 openings, which are used as hereafter described. This allows all operable components to extend outwardly from the front surface 75, rather than from the top 70, providing a lower profile. The top 70 thus can be substantially devoid of openings.

As one way of assembling the vacuum tank assembly 10 illustrated in FIG. 1, one inserts the adapter 40 portion 45 into the interior 85 of the annular portion 84 of the evacuator component 38 of the dip tube assembly, the O-rings 47 sealing tightly (air and water tight) with the surface 85. Then the components 38, 40, which are now connected together, are inserted into the interior of the tank 13 through the first opening 90 (see FIG. 2) in the recessed portion 74 of the front wall 75 of the tank 13, the locating tab 83 being inserted into the cut out 82 therefor. The outer surface of portion 84 makes a tight friction fit with the portion of tank 13 defining the first opening 90. When the dip tube assembly is so inserted the open bottom 46 is adjacent, e.g. just slightly above, the bottom of the interior of the tank 13 adjacent its lowest interior point, and under normal circumstances the level of pumpable slurry in the tank 13 will be well above the opening 46 before operation of the pump 14.

The end 41 of the adapter 40 is then mated with the conduit 20 by screw thread engagement between the conduit 20 and the screw threads 42, and if not already connected to the pump 14 the conduit 20 is connected to the pump 14. The vacuum switch 66 is inserted into the second opening 91 in the tank 13 front wall 75, and the sewage inlet conduit 50 placed into the third opening 92 (see FIGS. 2 and 13). The end 54 of the sewage inlet conduit 50 is connected up to a vacuum toilet, and the conduit 21 extending from the pump 14 is connected up to a holding tank. When the vacuum switch 66 operates the motor 64 to power the pump 14, slurry within the tank 13 is pulled up through the open bottom 46 of the rear portion 44 of the evacuator component 38 of the dip tube assembly, and is pumped through the pump 14 into the holding tank. Once the desired level of vacuum is reached in the tank 13, the vacuum switch 66 cuts the motor 64 off and the desired level of vacuum is maintained in the tank 13.

An alternative way of assembling the components is to first screw thread the threaded connection 42 to a conduit 20 (which may or may not already be connected to the pump 14), and then insert the portion 45 of the adaptor 40 into the interior 85 of the annular portion of evacuator component 38 of the dip tube assembly. The dip tube assembly is then inserted into association with the tank 13 as described above.

In the embodiment illustrated in FIGS. 13 through 16 components substantially identical to those in the embodiment of FIG. 1 are illustrated by the same reference numeral, and components that are similar but not identical are illustrated by the same reference numeral only preceded by a "1".

The primary difference between the embodiment of FIGS. 13 through 16 and that of FIG. 1 is the details of the evacuator component 138 of the dip tube assembly. Note that for the embodiment of the evacuator component 138 illustrated in FIGS. 13 through 16 that the structure is constructed by assembling together four different pieces, 119 (with the integral portion 184 thereof), 144,188, and 183. Those components may be friction fit together, or connected together by adhesive, or held together by other conventional methods. The locator 183 has a post 94 extending from the bottom thereof which post 94 fits in a cooperating opening 95 in the component 119. The locator 183 is polygonal in cross-section (e.g. square) and the cut out 82 with which it cooperates in the front face 75 of the tank 13 is dimensioned and configured to receive the component 183. The post 94 may either make a friction fit in the opening 95, or may screw thread into it, or otherwise releasably attach to it.

Figure 13:
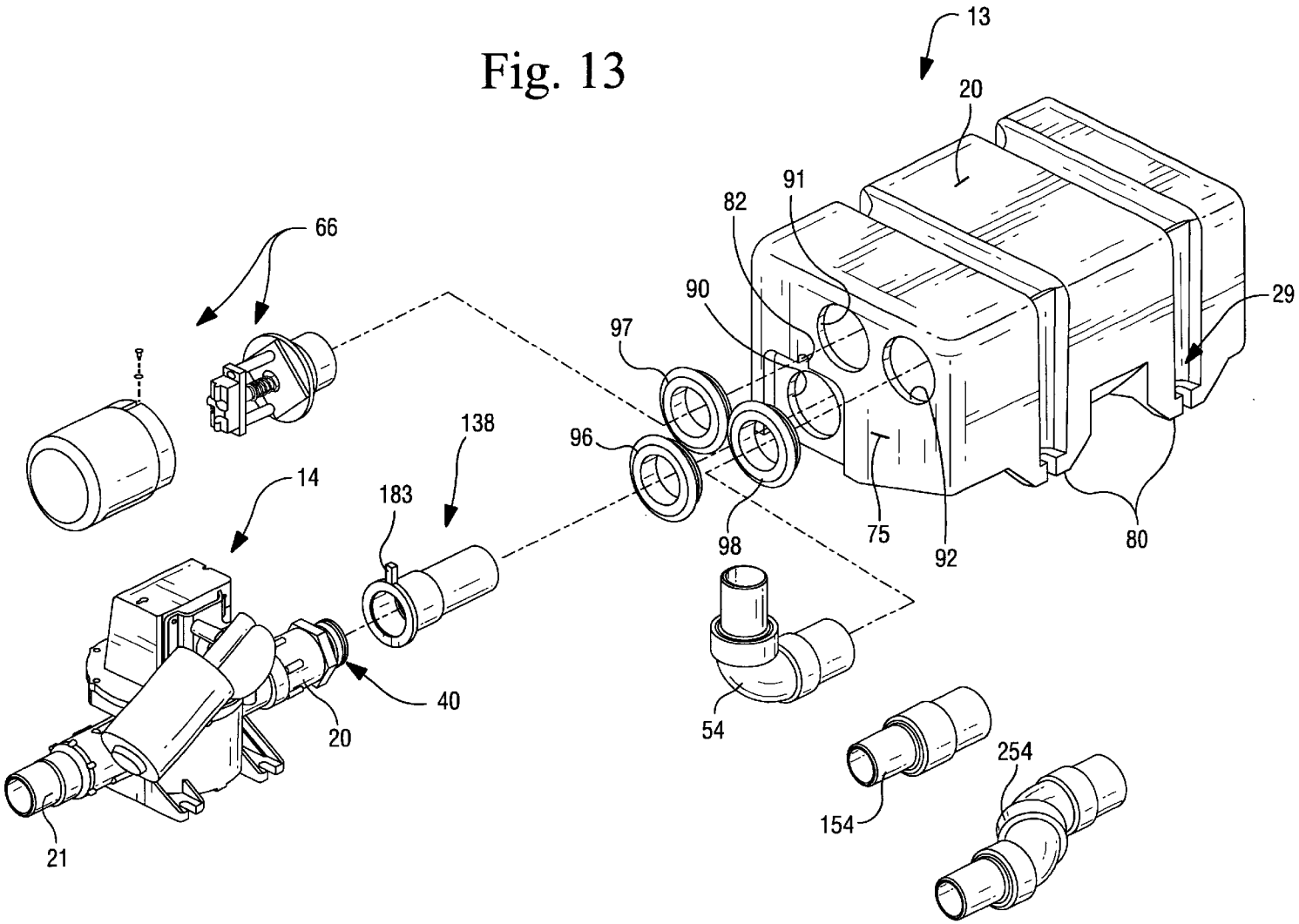
FIG. 13 is an exploded perspective of an exemplary vacuum tank assembly like that of FIG. 1, only with some differences in the dip tube assembly and alternative conduits.
Figure 14:
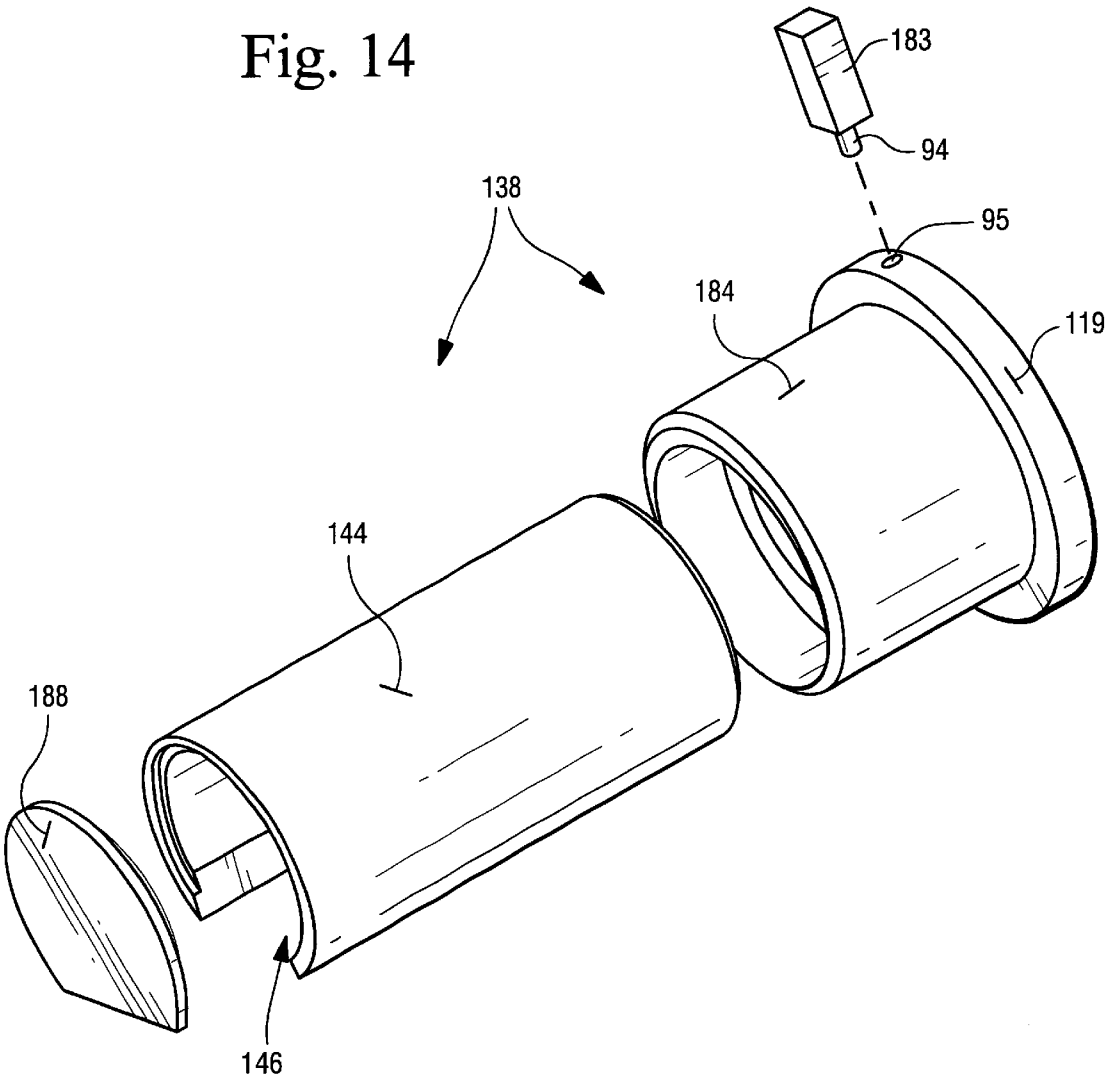
FIG. 14 is an exploded perspective view of the dip tube assembly evacuator component of FIG. 13.
Figure 15:
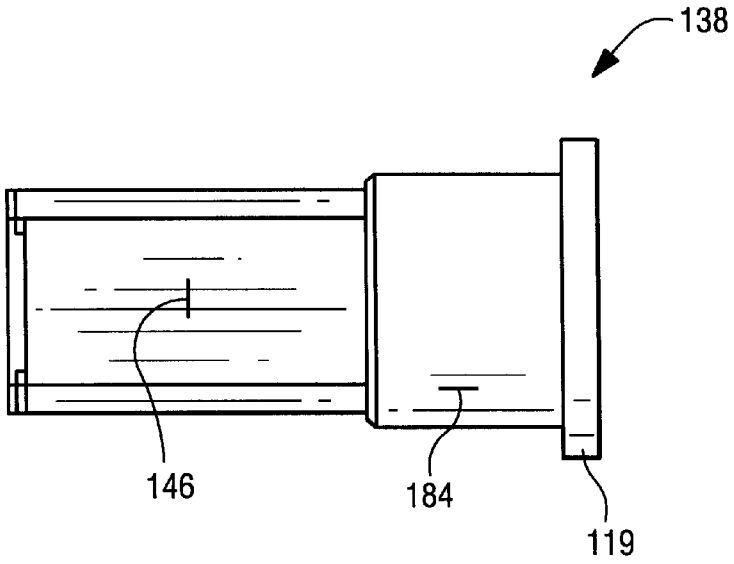
FIGS. 15 and 16 are, respectively, bottom plan and longitudinal cross-sectional views of the assembled evacuator component of the dip tube assembly of FIG. 14.
Figure 16:
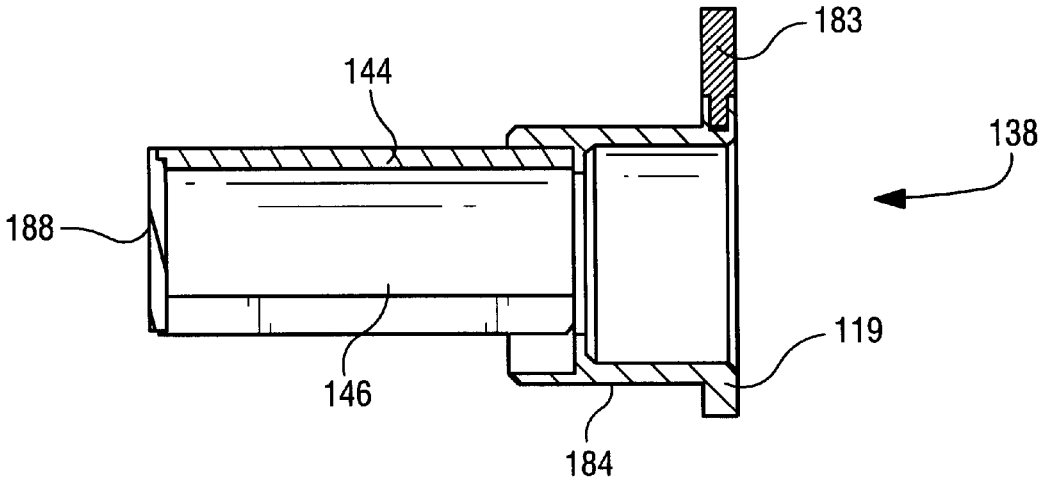

In the FIG. 13 embodiment, the conduit 54 provides one particular connection to a vacuum toilet or the like, however the conduits 154, 254 may instead be utilized in association with the third opening 92 depending upon where the vacuum toilet is located. Other configurations besides those illustrated at 54, 154, and 254 may also be utilized.

Also for the FIG. 13 embodiment the inserts 96–98 may be provided which mount in the openings 90, 91, 92, respectively, and receive the components 138, 66, 54, respectively. The bushings 96–98 may be adhesively secured to, secured by friction fit, or screw threaded, into operative association with the openings 90–92, respectively, and typically the components 138, 66 and 54 will have a friction or interference with the bushings 96–98.

A wide variety of dimensions may be provided for the components. However for example as one exemplary (only) set of dimensions, the internal diameter of the portion 84, 184 of the evacuator component 38,138 of the dip tube assembly may be about 1.5–1.75 inches, the length of the component 138, 38 from the portion 19,119 to the portion 88, 188 may be about 4–5.5 inches, the outside diameter of the portion 44 may be about 1.5–2.0 inches, and the tank 13 may have a length of about 12–20 inches (e.g. about 14½ inches).

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A vacuum tank assembly comprising:

a plastic vacuum tank having a substantially hollow interior, and a generally rectangular prism exterior configuration, including top, bottom, front, rear, and side surfaces;

wherein said top surface is substantially devoid of openings, and wherein said tank has no continuous flat surface greater than 80 square inches in area;

a first, second and third openings in said front surface, wherein said first opening is adjacent said bottom surface; and a dip tube assembly mounted in said first opening and extending into said substantially hollow interior in a position for readily withdrawing sewage in said tank adjacent said bottom surface thereof, and constructed to readily connect to a vacuum pump.

2. An assembly as recited in claim 1 wherein said second opening is operatively connected to a vacuum switch, and wherein said third opening is operatively connected to a sewage inlet conduit.

3. An assembly as recited in claim further comprising a vacuum pump and outlet conduit connected to said dip tube assembly.

4. An assembly as recited in claim 3 wherein said dip tube assembly comprises an adaptor and an evacuator component, said adaptor connecting said evacuator component to an outlet conduit or vacuum pump, and said evacuator component comprising a substantially tubular evacuation portion having a substantially flat open bottom closely overlying said tank bottom surface in said tank substantially hollow interior.

5. An assembly as recited in claim 4 wherein said top surface is substantially devoid of openings, and wherein said tank has no continuous flat surface greater than 80 square inches in area.

6. An assembly as recited in claim 1 wherein said dip tube assembly comprises an adaptor and an evacuator component, said adaptor connecting said evacuator component to an outlet conduit or vacuum pump, and said evacuator component comprising a substantially tubular evacuation portion having a substantially flat open bottom closely overlying said tank bottom surface in said substantially hollow interior.

7. An assembly as recited in claim 6 wherein said adaptor comprises a mounting flange and a substantially tubular rear portion extending outwardly from said mounting flange, said rear portion having at least one sealing element associated with an exterior surface thereof; and wherein said evacuator component comprises a substantially tubular connector portion having an interior surface making a substantially air and liquid-tight seal with said sealing element.

8. An assembly as recited in claim 7 wherein said evacuator component connector portion has at least one radially extending locator tab; and further comprising at least one cut out in said tank front surface adjacent said first opening cooperating with said tab to properly orient said evacuator component in said tank.

9. An assembly as recited in claim 8 wherein said locator tab is integral with said evacuator component connector portion.

10. An assembly as recited in claim 6 wherein said evacuator component has at least one radially extending locator tab; and further comprising at least one cut out in said tank front surface adjacent said first opening cooperating with said tab to properly orient said evacuator component in said tank.

11. An assembly as recited in claim 10 wherein said locator tab has a substantially polygonal cross-section and is removably mounted to said evacuator component.

12. A vacuum tank assembly comprising:

a vacuum tank having a substantially hollow interior and an exterior having top, bottom, and front surfaces;

a first opening in said front surface;

a dip tube assembly mounted in said first opening in a position for readily withdrawing sewage in said tank adjacent said bottom surface thereof, and constructed to readily connect to a vacuum pump; and wherein said dip tube assembly comprises an adaptor and an evacuator component, said adaptor connecting said evacuator component to an outlet conduit or vacuum pump, and said evacuator component comprising a substantially tubular evacuation portion having a substantially flat open bottom closely overlying said tank bottom surface in said substantially hollow interior, and wherein said adaptor comprises a mounting flange and a substantially tubular rear portion extending outwardly from said mounting flange, said rear portion having at least one sealing element associated with an exterior surface thereof; and wherein said evacuator component comprises a substantially tubular connector portion having an interior surface making a substantially air and liquid-tight seal with said sealing element.

13. An assembly as recited in claim 12 wherein said evacuator component connector portion has at least one radially extending locator tab; and further comprising at least one cut out in said tank front surface adjacent said first opening cooperating with said tab to properly orient said evacuator component in said tank.

14. An assembly as recited in claim 13 wherein said locator tab is integral with said evacuator component connector portion.

15. A dip tube assembly comprising:

an adaptor and an evacuator component, said adaptor connecting said evacuator component to an outlet conduit or vacuum pump, and said evacuator component comprising a substantially tubular evacuation portion having a substantially flat open bottom closely overlying a tank bottom surface in a tank open interior; and said adaptor further comprising a mounting flange and a substantially tubular rear portion extending outwardly from said mounting flange, said rear portion having at least one sealing element associated with an exterior surface thereof, and said evacuator component further comprising a substantially tubular connector portion having an interior surface making a substantially air and liquid-tight seal with said sealing element; and at least one locator tab extending radially outwardly from said evacuator component connector portion.

* * * * *

UNITED STATES PATENT AND TRADEMARK OFFICE

CERTIFICATE OF CORRECTION

PATENT NO. : 6,618,866 B1
DATED : September 16, 2003
INVENTOR(S) : Lorna K. Edmondson It is certified that error appears in the above-identified patent and that said Letters Patent is hereby corrected as shown below:

Column 6,
Line 46, please delete “claim”, and insert therefor -- claim 2 --.

Signed and Sealed this

Twentieth Day of January, 2004

JON W. DUDAS
*Acting Director of the United States Patent and Trademark Office*